US010337513B2

(12) United States Patent
Reul et al.

(10) Patent No.: US 10,337,513 B2
(45) Date of Patent: Jul. 2, 2019

(54) ELECTRIC-MOTOR-DRIVEN LIQUID PUMP

(71) Applicant: FTE automotive GmbH, Ebern (DE)

(72) Inventors: Alexander Reul, Frensdorf Reundorf (DE); Markus Dirauf, Ebern (DE)

(73) Assignee: FTE automotive GmbH, Ebern (DE)

( * ) Notice: Subject to any disclaimer, the term of this patent is extended or adjusted under 35 U.S.C. 154(b) by 54 days.

(21) Appl. No.: 15/373,721

(22) Filed: Dec. 9, 2016

(65) Prior Publication Data

US 2017/0167491 A1 Jun. 15, 2017

(30) Foreign Application Priority Data

Dec. 9, 2015 (DE) ..... 10 2015 015 863

(51) Int. Cl.
*F04C 15/00* (2006.01)
*F04B 17/03* (2006.01)
(Continued)

(52) U.S. Cl.
CPC ..... *F04C 15/0096* (2013.01); *F04B 17/03* (2013.01); *F04B 53/08* (2013.01);
(Continued)

(58) Field of Classification Search
CPC ..... F04D 1/04; F04D 13/06; F04D 13/0646; F04D 25/06; F04D 25/0606; F04D 29/40;
(Continued)

(56) References Cited

U.S. PATENT DOCUMENTS 5,997,261 A * 12/1999 Kershaw ..... F04D 29/588 310/54
6,585,498 B2 * 7/2003 Arbogast ..... F04B 1/128 417/353

(Continued)

FOREIGN PATENT DOCUMENTS

DE 102008034176 1/2010
DE 102008034176 A1 * 1/2010 ..... F04C 2/086
JP 2013183603 9/2013

OTHER PUBLICATIONS

European Search Report; No. EP16002579 dated Feb. 10, 2017; 7 pages.

(Continued)

*Primary Examiner* — Kenneth J Hansen
*Assistant Examiner* — Chirag Jariwala
(74) *Attorney, Agent, or Firm* — Reising Ethington, P.C.

(57) ABSTRACT

A liquid pump has a housing with a suction connection, a pressure connection and a electric motor for rotationally driving a conveying device that has a suction inlet and pressure outlet which communicate with the suction connection and the pressure connection respectively. An electronic power unit for the electric motor is adjacent to the motor and extends transversely to the axis of rotation and is on the rear side of the partition wall of the housing. The suction inlet is arranged at a height smaller than an inner radius of an annular gap between the stator and rotor, whereas a rotor passage extends at a constant height, so that a liquid inducted by way of the suction connection is guided (Continued)

in part via the annular gap and undergoes a deflection at the partition wall, cooling the latter before it passes through the rotor passage to the suction inlet.

20 Claims, 4 Drawing Sheets

(51) Int. Cl.

| | |
|---|---|
| ***F04B 53/08*** | (2006.01) |
| ***F04D 13/06*** | (2006.01) |
| ***F04D 29/58*** | (2006.01) |
| ***F04D 1/04*** | (2006.01) |
| ***F04C 2/10*** | (2006.01) |

(52) U.S. Cl.
CPC ..... *F04C 2/102* (2013.01); *F04D 1/04* (2013.01); *F04D 13/06* (2013.01); *F04D 13/0653* (2013.01); *F04D 29/586* (2013.01); *F04D 29/5806* (2013.01); *F04D 29/5813* (2013.01)

(58) Field of Classification Search
CPC .... F04D 29/406; F04D 29/426; F04D 29/445; F04D 29/586; F04D 13/0653; F04D 29/58; F04D 29/5806; F04D 29/5813; F04D 29/588; F04C 2/08; F04C 2/10; F04C 2/101; F04C 2/102; F04C 15/0096; F04B 17/03; F04B 53/08; H02K 9/19
USPC ..... 417/350, 357, 368, 369, 370, 410.1, 417/410.3, 410.4, 410.5; 310/54, 57, 310/60 R, 61
See application file for complete search history.

(56) References Cited

U.S. PATENT DOCUMENTS

| | | | | |
|---|---|---|---|---|
| 7,036,892 | B2 * | 5/2006 | Suzuki | F04C 2/102 303/116.4 |
| 7,367,787 | B2 * | 5/2008 | Arbogast | F04B 17/03 417/353 |
| 7,381,036 | B2 * | 6/2008 | Hundt | F04C 11/001 417/355 |
| 8,038,423 | B2 | 10/2011 | Nakayoshi | |
| 9,068,563 | B2 | 6/2015 | Fukasaku | |
| 9,175,680 | B2 | 11/2015 | Miyaki et al. | |
| 2004/0136847 | A1 | 7/2004 | Arbogast et al. | |
| 2006/0140810 | A1 | 6/2006 | Kameya et al. | |
| 2012/0128513 | A1 * | 5/2012 | Sakata | F04C 2/086 417/410.1 |
| 2013/0202464 | A1 * | 8/2013 | Miyaki | F01C 21/10 417/410.4 |
| 2014/0248166 | A1 * | 9/2014 | Shirinov | F04D 19/04 417/372 |
| 2014/0294624 | A1 * | 10/2014 | Suitou | F04C 29/047 417/410.1 |
| 2015/0037177 | A1 * | 2/2015 | Buchholz | F04D 13/021 417/319 |
| 2016/0233814 | A1 * | 8/2016 | Okamoto | H02P 6/00 |

OTHER PUBLICATIONS

German Office Action; Applicant: FTE automotive GmbH; Appln. No. 10 2015 015 863.5; dated Oct. 28, 2016.

Mexican Office Action, Applicant: FTE automotive GmbH, Application No. MX/a/2016/015976, dated May 7, 2018, 3 pages.

* cited by examiner

ELECTRIC-MOTOR-DRIVEN LIQUID PUMP

TECHNICAL FIELD

The present invention relates to electric-motor-driven liquid pumps made predominantly from plastic material components to be used on a large scale in the automobile industry as, for example, lubricating oil pumps, cooling oil pumps, auxiliary oil pumps or actuator pumps so as to contribute, by virtue of their low weight and their capability to have electrical drive control that is regulated to need, to a reduction in fuel consumption and $CO_2$ emissions.

PRIOR ART

Low emission of pollutants and lowest possible fuel consumption during operation of a motor vehicle have, as has become known, an important role in the development of new vehicles and vehicle concepts; these aspects will be even more in the focus of developers in the future, also due to legal regulations. Given this objective, regulable electrical oil pumps can be variously used in the area of the drive train of a motor vehicle, particularly within the transmission and also in the transmission sphere. Thus, the pumps are usable in, for example, CVT (Continuously Variable Transmission) transmissions, IVT (Infinitely Variable Transmission) transmissions and twin-clutch transmissions not only as lubricating oil pumps, but also as cooling oil or actuating pumps and, in particular, suitably in line with demand as well as optimized in performance, since their rotational speed and flow can be regulated. By contrast to conventional oil pumps, drive of the pumps in question takes place not through mechanical coupling to, for example, a shaft of the internal combustion engine or transmission, but by an electric motor with the assistance of electrical energy from the on-board power source or battery of the motor vehicle. It is thus possible in specific situations, for example when the internal combustion engine is stopped in start/stop operation of the motor vehicle, to convey oil for lubrication and/or cooling purposes.

Further demands on pumps arise from the place of installation of the pumps in the motor vehicle near the medium which has to be conveyed (for example in the oil sump) or near the point where the conveyed medium is needed for lubrication and/or cooling purposes, i.e. usually within or at least in the vicinity of the transmission housing. On the one hand, the available installation space within or in the vicinity of the transmission housing is usually very meager in size, so that the pump has to be constructed as compactly as possible. On the other hand, it is necessary to ensure reliable functioning of the pump over a relatively large temperature range, which can extend from, for example, −40° C. in winter operation with a cold engine to +150° C. in summer operation with a hot engine. These requirements are mutually contradictory: the more compact the construction of the pump for a given pump output, for example pressures up to 30 bars or volume flows up to 25 liters per minute in transmission applications, has to be the more difficult it can be to ensure reliable functioning of the pump over a large temperature range. In that case, in the low temperature range the high viscosity of the oil in conjunction with small flow cross-sections, in particular, can prove problematic, whereas at high temperatures the primary challenge is adequate heat dissipation from the electric motor.

Document JP 2013-183603 A (FIGS. 1 to 3(b)) discloses an electric-motor-driven liquid pump comprising a housing with a suction connection and a pressure connection. Integrated in the housing is an electric motor which is executed as an internal rotor motor and comprises a stator and a rotor, the latter being received within the stator to leave an annular gap and being drivable to rotate about an axis of rotation. A conveying device in the form of a G rotor (Generated rotor) pump device is drivably connected with the rotor and has a suction inlet in fluid connection with the suction connection and a pressure outlet in fluid connection with the pressure connection. An electronic power unit, which is similarly arranged in the housing, is additionally provided for activation of the electric motor. More precisely, the rotor has a partition wall which extends substantially transversely to the axis of rotation and is adjacent to the rotor and which bounds a flooded motor interior space, the electronic power unit being mounted on the dry side of the wall remote from the rotor.

In this prior art, the arrangement of the pump components provides the liquid entering the liquid pump via the suction connection of the housing initially has to pass through the motor interior space before it reaches the suction inlet of the conveying device, which has the purpose of cooling the electric motor in the region of the rotor and stator. In that case, the electronic power unit, which similarly generates and delivers heat, is spaced so far from the motor interior space—room is even left for one of the two end rotor bearings in or at the partition wall of the housing—that a greater degree of heating of the motor interior space by the electronic power unit would not really be expected. However, care still has to be given to adequate dissipation of the heat generated by the electronic power unit. Moreover, in this construction there is a significant axial installation space requirement, which limits the possibilities of use of such a pump in small spaces.

What is desired is an electric-motor-driven liquid pump for transmission applications in motor vehicles, where the pump has the lightest and most compact construction possible, avoids the above disadvantages and has optimized cooling by comparison with the outlined prior art.

SUMMARY OF THE INVENTION

According to one aspect of the invention, in an electric-motor-driven liquid pump—which includes a housing, which has a suction connection and a pressure connection, for receiving an electric motor, which has a stator and a rotor which is received within the stator to leave an annular gap and is rotationally drivable about an axis of rotation. A conveying device, which is in drive connection with the rotor has a suction inlet in fluid connection with the suction connection and a pressure outlet in further connection with the pressure connection. An electronic power unit drives the electric motor. The housing has a partition wall which extends substantially transversely to the axis of rotation and is adjacent to the rotor and on the side of which the electronic power unit is mounted remote from the rotor. The suction inlet of the conveying device is arranged with respect to the axis of rotation at a radial height smaller than an inner radius of the annular gap, whereas the rotor has at least one passage which extends at a radial height which is substantially constant with respect to the axis of rotation or increases towards the suction inlet of the conveying device, so that a liquid inducted by the suction inlet of the conveying device via the suction connection of the housing is constrainedly guided partly by way of the annular gap between rotor and stator and undergoes deflection at the partition wall of the housing, while cooling the wall, before it passes through the passage of the rotor to the suction inlet of the conveying device.

In the liquid pump according to one aspect of the invention the liquid is thus advantageously used on the suction side of the conveying device for cooling purposes. This is more efficient by comparison with similar prior solutions in which a part of the conveyed liquid is branched off on the pressure side of the conveying device for pump cooling. This is because, firstly, the liquid conveyed by the conveying pump can at the pressure side be delivered in its entirety by way of the pressure connection—thus there is no dividing up for cooling purposes. Secondly, the liquid, for example transmission oil, "heated up" at the suction side of the conveying device by way of the electric motor and the electronic power unit can be more easily conveyed because the internal friction in the liquid is less due to the temperature-induced change in viscosity.

Moreover, in the liquid pump according to one aspect of the invention a flow with a predetermined direction in the pump housing is constrained in the region of the electric motor as a consequence of the physical arrangement of the suction inlet of the conveying device with respect to the annular gap between rotor and stator as well as the at least one passage in the rotor referred to the axis of rotation of the rotor. Liquid passing by way of the suction connection of the housing into the annular gap between rotor and stator is, in particular, additionally drawn in a forced flow through the annular gap, deflected at the partition wall of the housing and conducted through the at least one passage in the rotor to the suction inlet of the conveying device. In that case there is dissipation not only of heat, which is generated by the stator windings, by way of the liquid flowing through the annular gap and cooling the stator, but also of heat which is generated by the electronic power unit and which is conducted through the partition wall and entrained by the inducted liquid by its sweeping, with cooling effect, along the partition wall. In its further path to the suction inlet of the conveying device by way of the at least one passage in the rotor the liquid is not in any way checked by the centrifugal forces produced as a consequence of the rotation of the rotor (path of the passage at a substantially constant radial height), but may even be assisted ("rising" path of the passage towards the suction inlet of the conveying device).

As a result, there is optimized cooling of the liquid pump according to one aspect of the invention in the region of the electric motor and the electronic power unit. This in turn makes it possible to bring the electric motor, in particular the stator thereof, and the electronic power unit nearer to one another or closer together by comparison with the known prior art, which is not only needed for a particularly compact design of the liquid pump, but also leads to weight saving due to smaller housing mass. This compact construction executed with high power density makes the liquid pump according to the invention just right for, for example, direct installation as an oil pump within a transmission housing, but due to the small constructional space requirement it is usually also possible to mount outside the transmission housing without problems.

In an advantageous development of one embodiment of the liquid pump, in which the stator of the electric motor has a plurality of metallic stator laminations which carry stator windings and have radial ends adjoining the annular gap, the stator laminations and the stator windings can be connected together through injection-molded enclosure by plastic material in such a way that the radially inner ends of the stator laminations are left free of the plastic material injection-molded enclosure. At the outset, it is to be emphasized in this connection that plastic material is superior to air in heat transmission properties; advantageously, coils of the stator windings embedded in injection-molded plastic material can thus distribute heat better than if only surrounded by air. If a stator has a plastic material injection-molded enclosure it is also possible to dispense with expensive fixing of the individual wires of the stator core. In addition, if the radially inner ends of the stator laminations are left free of the plastic material injection-molded enclosure there is particularly good heat dissipation by the liquid which sweeps past the free stator lamination ends and is inducted via the annular gap.

In that case, the radially inner ends of the stator laminations can in principle be flush with the plastic material injection-molded enclosure in the annular gap. However, with respect to a largest possible flow cross-section at the annular gap between stator and rotor on the one hand and yet a small, energy-efficient radial spacing between the stator lamination ends and the rotor on the other hand it is preferred if the radially inner ends of the stator laminations protrude radially inwardly beyond the plastic material injection-molded enclosure and bound, together with the latter, grooves which advantageously form a part of the flow path. These are preferably axial grooves which extend substantially parallel to the axis of rotation and thus ensure short flow paths. However, other paths of the grooves are equally conceivable, for example a substantially helical path which in the case of appropriate orientation with respect to the rotational direction of the rotor could provide an additional conveying effect in the annular gap.

In that connection the grooves formed by the stator embedded in injection-molded plastic material can in principle be shorter than the annular gap. With respect to, again, a largest possible flow cross-section in the region of the annular gap it is, however, preferred if the grooves extend at least over the length of the rotor.

In a particularly preferred embodiment of the liquid pump the rotor of the electric motor can, moreover, be cantilever-mounted in the housing on the side of the rotor remote from the partition wall. This is needed on the one hand for axially short construction of the liquid pump. On the other hand, there is an advantage by comparison with mounting of the rotor (also) on the partition wall inasmuch as there is better flow of the inducted liquid against the partition wall and this can be cooled over a greater area.

In further pursuit of the concept of the invention, the partition wall of the housing can—but does not have to—have on its side facing the rotor a projection, which is arranged concentrically with respect to the axis of rotation and protrudes in the direction of the rotor, for flow deflection. Such a projection advantageously promotes deflection of the flow of the inducted liquid from the partition wall in the direction of the rotor or the at least one passage thereof. In that case, the projection can have a central recess receiving a magnet which is connected with the rotor and serves for sensing the angular position of the rotor about the axis of rotation. If for electronic, i.e. brushless, commutation of the electric motor a magnet for detection of the rotational position of the rotor is indeed needed, an interior space provided in the projection can serve in space-saving manner for accommodation of the magnet.

Moreover, the rotor can have a plurality of passages which, in particular, extend substantially parallel to the axis of rotation and which with respect to the axis of the rotation lie at a radial height the same as or greater than an outer radius of the projection. Through provision of a plurality of passages in the rotor the flow cross-section for the liquid inducted through the rotor can, at the outset, be increased. In principle, the passages can in that case extend, for example, in the form of a helix, particular if this additionally produces, in conjunction with the rotation of the rotor, a conveying action. However, passages extending parallel to the axis of rotation are simpler and cheaper to produce. By virtue of the radial position of the passages at the height or outside the diameter of the projection there may be the further effect that the projection deflects the inducted liquid directly into the passages. This also favors the desired circulation of the inducted liquid in the housing of the liquid pump before the liquid reaches the suction inlet of the conveying device.

In addition, in order to improve the cold-running characteristics of the liquid pump a bypass connection can be provided which connects the suction connection of the housing in front of the annular gap, as seen in flow direction, with the suction inlet of the conveying device. Thus, in the case of particularly low temperatures and highly viscous liquids it can be ensured that a part of the inducted liquid is capable of bypassing the annular gap between stator and rotor so that even under these difficult preconditions it is possible to achieve the desired pump throughputs and/or pressures at the pressure connection of the liquid pump. In a particularly simple embodiment the bypass connection can in that case be formed by a further annular gap between an inner circumferential surface of the rotor and a wall surface of the housing.

Moreover, in an advantageous development of the liquid pump the housing can be closed on the side of the partition wall remote from the rotor by a metallic cover which for heat dissipation extends outwardly close to and across the electronic power unit and is optionally provided on its side remote from the electronic power unit with a surface-increasing structure such as cooling ribs. Supplementary heat dissipation achieved in that manner by way of a part of the housing is of advantage in the case of higher pump outputs and electronic power units of correspondingly more powerful form.

Although the rotor of the electric motor and the conveying device in drive connection therewith can in principle be arranged one behind the other on the axis of rotation of the liquid pump, optionally with a spacing from one another, it is preferred with respect to a liquid pump of particularly short axial construction if the rotor is constructed to be substantially cup-shaped and bounds an interior space in which the conveying device is received at least in part.

In a notably simpler embodiment, which is more economic especially in mass production, of the liquid pump the housing can moreover predominantly be made of plastic material, the rotor of the electric motor being mounted by way of a motor shaft directly in the plastic material of the housing, i.e. special bearings such as ball bearings or the like are not needed here. In that case, the arrangement can preferably be such that the rotor of the electric motor is in drive connection with the conveying device via the motor shaft which is mounted in the housing on either side of the conveying device by way of a respective bearing, wherein the bearing, which is further from the rotor, for the motor shaft is lubricated by way of the drive connection thereof with the conveying device so that additional measures for bearing lubrication can be dispensed with.

Finally, in principle, various types of pumps can be used as the conveying device: thus, the conveying device of the liquid pump according to the invention can be constructed in the manner of, for example, a piston pump, a vane pump, a roller pump, a centrifugal pump or any form of gear pump. For a relatively low pressure range an embodiment of the liquid pump is preferred, particularly with respect to low production costs, in which the conveying device is constructed in the form of an internal gear pump, comprising a gearwheel, which is rotationally driven by the rotor of the electric motor and is arranged concentrically with respect to the axis of rotation, with an outer toothing and an annular gear, which meshes with the outer toothing and is guided eccentrically in the housing with respect to the axis of rotation, with an inner toothing which co-operates with the outer toothing so as to convey liquid. Such a conveying device accordingly needs merely two, optionally sintered, rotor parts (gearwheel and annular gear).

BRIEF DESCRIPTION OF THE DRAWINGS

The invention is explained in more detail in the following by way of a preferred embodiment with reference to the accompanying, partly schematic, drawings in which for simplification of the illustration elastomeric or elastic parts are illustrated in the undeformed state and in which.

DETAILED DESCRIPTION OF THE EMBODIMENT

Figure 1:
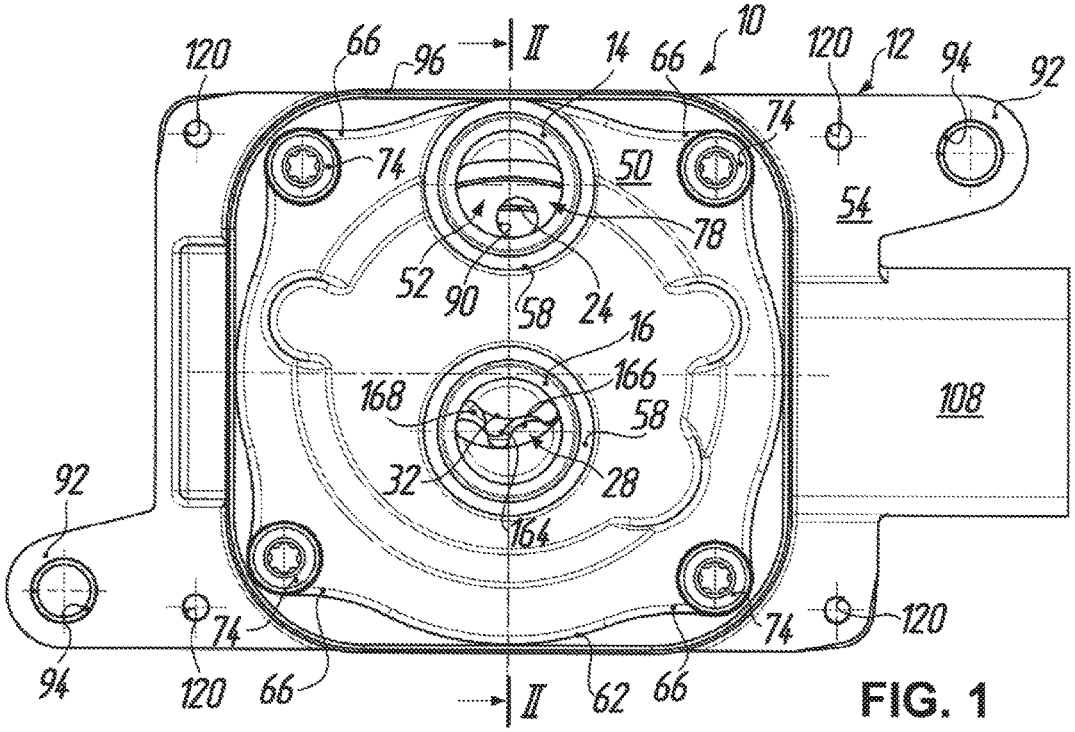
FIG. 1 shows a plan view of an electric-motor-driven liquid pump according to a preferred embodiment of the invention in an unmounted state, with a view onto a hydraulic connection side of the liquid pump, at which the housing thereof has a suction connection and a pressure connection.

In the figures the reference numeral 10 denotes generally an electric-motor-driven liquid pump which can be used in or at a transmission for motor vehicles, particularly as an oil pump for cooling and/or lubricating purposes. The liquid pump 10 has a housing which is denoted generally by 12 and which has a suction connection 14 and a pressure connection 16. As FIG. 2, in particular shows an electric motor 18 is arranged in the housing 12 and includes a stator 20 at the housing and an internal rotor 22. The rotor 22 is received within the stator 20 so as to leave an annular gap 24 and is rotationally drivable about an axis 26 of rotation. A conveying device which is denoted generally by 28 in FIGS. 2 and 4 and which has a suction inlet 30 in fluid connection with the suction connection 14 of the housing 12 and a pressure outlet 32 in fluid connection with the pressure connection 16 of the housing 12 is drivably connected with the rotor 22 of the electric motor 18. In addition, an electronic power unit 34 for activation of the electric motor 18 is provided in the housing 12. The housing 12 has a partition wall 36 which extends substantially transversely to the axis 26 of rotation and is adjacent to the rotor 22. The partition wall 36 bounds an interior space 38, which in operation is flooded with the liquid to be conveyed, of the housing 12, in which the rotor 22 accordingly is wet-running. The electronic power unit 34 is mounted in the housing 12 on the dry side of the partition wall 36 remote from the rotor 22.

Figure 2:
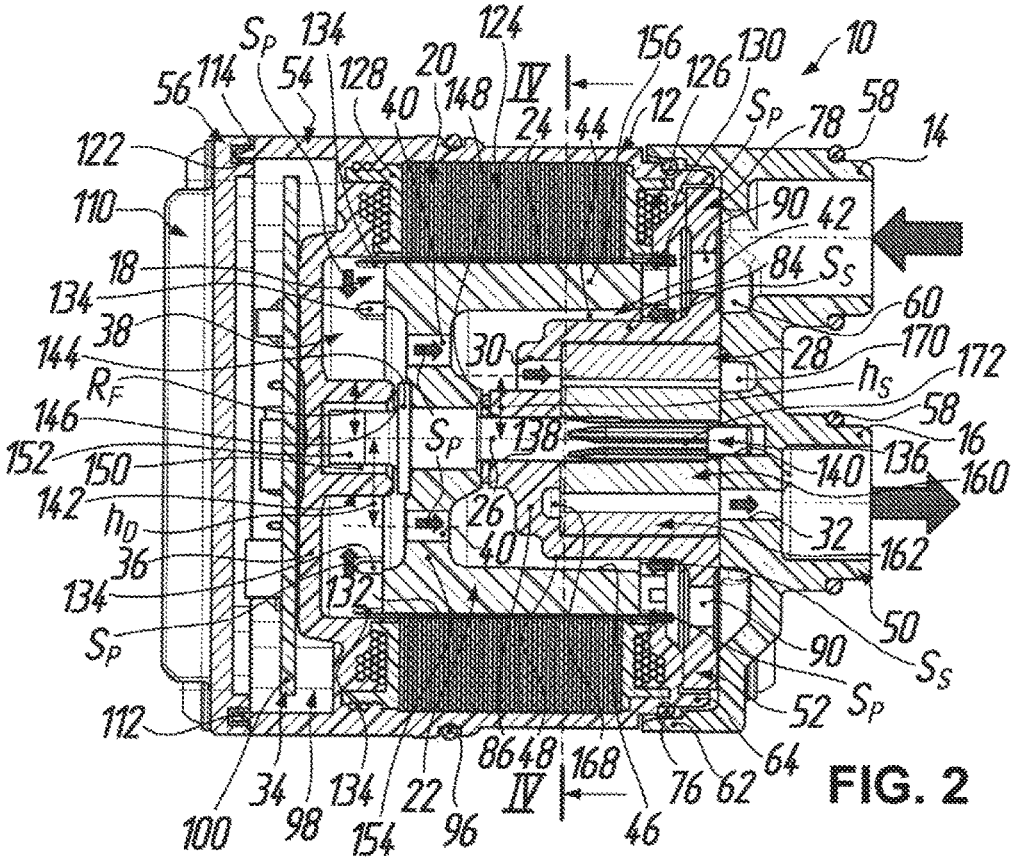
FIG. 2 shows a sectional view of the liquid pump according to FIG. 1 in correspondence with the section line II-II in FIG. 1, wherein the flow directions of the conveyed liquid are indicated by arrows.

As will be described in more detail in the following, the suction inlet 30 of the conveying device 28 is arranged with respect to the axis 26 of rotation at a radial height $h_s$ which is smaller than an inner radius $r_R$ of the annular gap 24 (cf. FIGS. 2 and 4). The suction inlet 30 thus lies at least partly radially within the annular gap 24 as seen along the axis 26 of rotation. Meanwhile, the rotor 22 has at least one passage 40—in the illustrated embodiment even four passages 40 uniformly angularly spaced about the axis 26 of rotation (cf. FIG. 8)—which, as illustrated in FIG. 2, extends at a radial height $h_D$ which is substantially constant with respect to the axis 26 of rotation (or, but not shown, increases in direction towards the suction inlet of the conveying device). In other words, the radial spacing of the inner passage 40 in the rotor 22 from the axis 26 of rotation does not change as seen along the passage 40 (or, however, it increases—in the alternative embodiment, which is not illustrated, of the rotor—along the passage as seen in a direction from the partition wall towards the conveying device). This radial arrangement of the flow cross-sections constrains, in the liquid pump 10, a suction-side primary flow of the liquid to be conveyed in which liquid inducted by the suction inlet 30 of the conveying device 28 via the suction connection 14 of the housing 12 is in part forcibly conducted by way of the annular gap 24 between stator 20 and rotor 22 and undergoes a deflection at the partition wall 36 of the housing 12, where cooling of the partition wall 36 takes place, before it passes through the passage 40 (or the passages) of the rotor 22 to the suction inlet 30 of the conveying device 28. This primary flow, which arises in the interior space 38 of the housing 12, from the suction connection 14 in the housing 22 across the circumference of the rotor 22 towards the partition wall 36 and from there through the interior of the rotor 22 back to the conveying device 28 is indicated in FIG. 2 by the arrows $S_P$. The stator 20 of the electric motor 18 is cooled by this primary flow $S_P$, as is the partition wall 36 of the housing 12 heated by the electronic power unit 34, or a part of the heat generated in the stator 20 and in the electronic power unit 34 is dissipated.

In addition, in the illustrated embodiment the liquid pump 10 is, for improvement of cold-running characteristics, provided with a bypass connection 42 which connects the suction connection 14 of the housing 12 in front—as seen in flow direction—of the annular gap 24 between stator 20 and rotor 22 with the suction inlet 30 of the conveying device 28. This bypass connection 42 is here formed by a further annular gap 44 between an inner circumferential surface 46 of the rotor 22 and a wall surface 48 of the housing 12. A secondary flow of the liquid inducted by the conveying device 28, which is indicated in FIG. 2 by the arrows $S_S$, thereby arises primarily in initial or cold running of the liquid pump 10. Thus, even in the cold state of the liquid pump 10, a desired conveying volume can be guaranteed particularly when highly viscous oils are the liquid to be conveyed.

Figure 3:
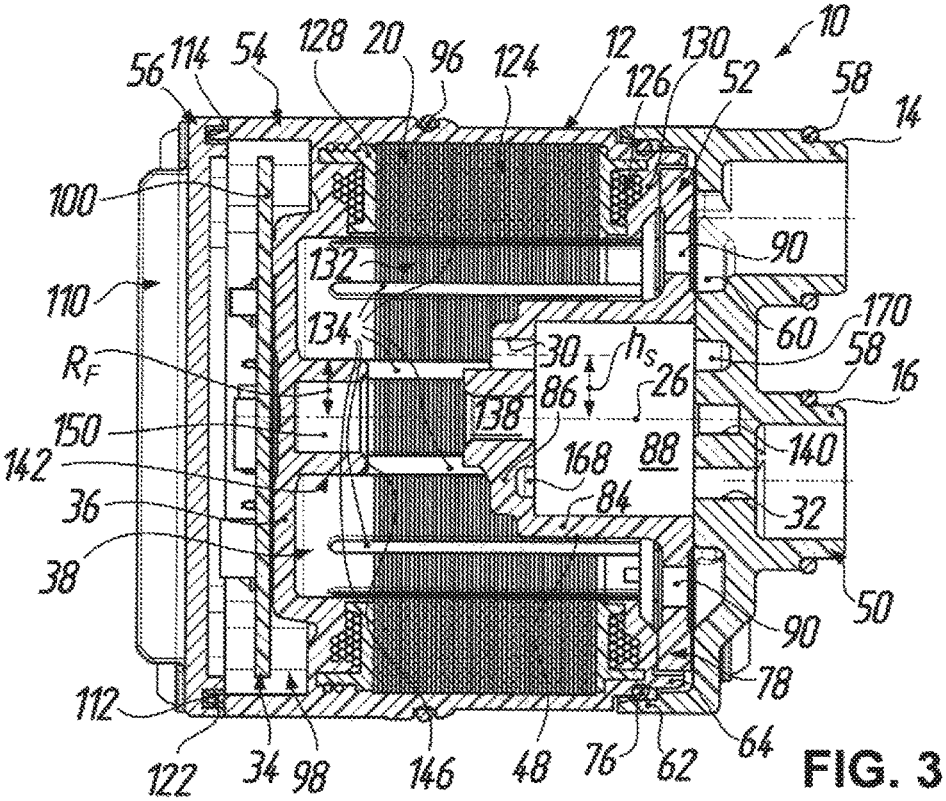
FIG. 3 shows a sectional view, which corresponds with respect to the section plane of FIG. 2, of the liquid pump according to FIG. 1, in which for clarification of further details in the housing the rotating components of an electric motor and a conveying device of the liquid pump have been omitted.
Figure 6:
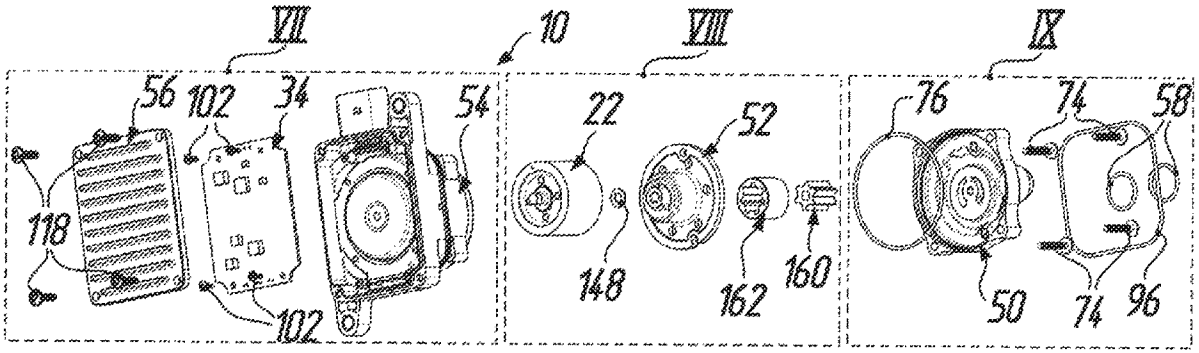
FIG. 6 shows a perspective exploded view of the liquid pump according to FIG. 1, which in the plane of the drawing of FIG. 1 is turned through 90° in anti-clockwise sense, from obliquely from below and back right, starting with a view onto a metallic cover of the housing.

Further details of the housing 12, which is principally injection-molded from plastic material, can be inferred from, in particular, FIGS. 3 and 6 to 9. Accordingly, the housing 12 substantially consists of four parts or sections, namely—as seen in FIG. 3 from the right to the left—a connection housing section 50, a pump housing section 52, a motor housing section 54 and a cover 56, which in the illustrated embodiment is formed as a single housing section of a metal, more specifically an aluminum alloy.

Figure 9:
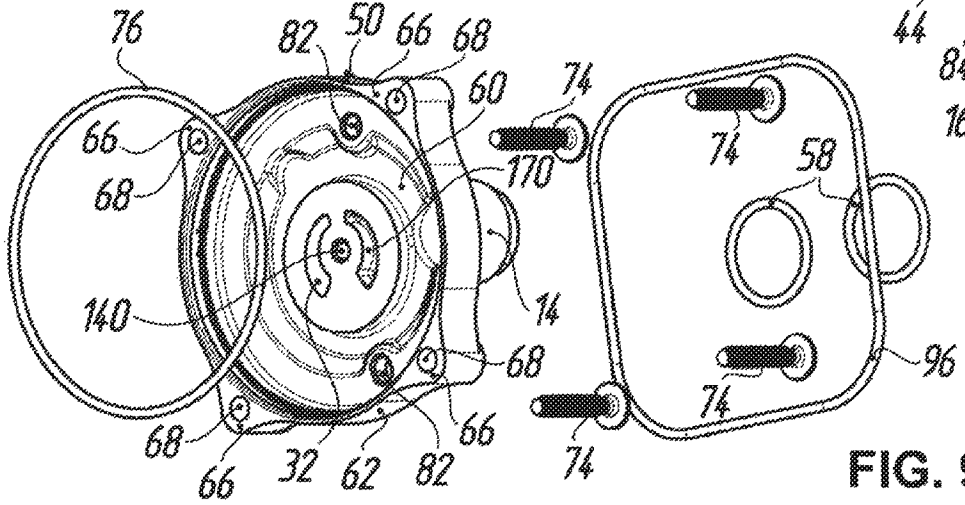
FIG. 9 shows an enlarged illustration of the detail IX in FIG. 6, which shows, in particular, a connecting housing section of the housing at which the suction connection and the pressure connection of the liquid pump are formed.

The suction connection 14 and the pressure connection 16 of the liquid pump 10 are integrally formed at the connection housing section 50 on its outer side at the top in FIG. 1 and on the right in FIGS. 2 and 3. An O-ring 58, which serves for sealing relative to a transmission-side connection mating member (not shown), is mounted on the outer circumference of each connection 14, 16. A recess 60, which according to FIG. 9 is substantially circularly annular and which intersects and therefore communicates with the suction connection 14, is formed on the inner side, which is at the left in FIGS. 2 and 3, of the connecting housing section 50. The pressure outlet 32, which is substantially kidney-shaped as seen in plan view, of the conveying device 28 is disposed radially within the encircling recess 60 and separately therefrom (cf. FIG. 9), which outlet extends through the connection housing section 50 and according to FIGS. 2 and 3 opens in the pressure connection 16 of the liquid pump 10.

Figure 7:
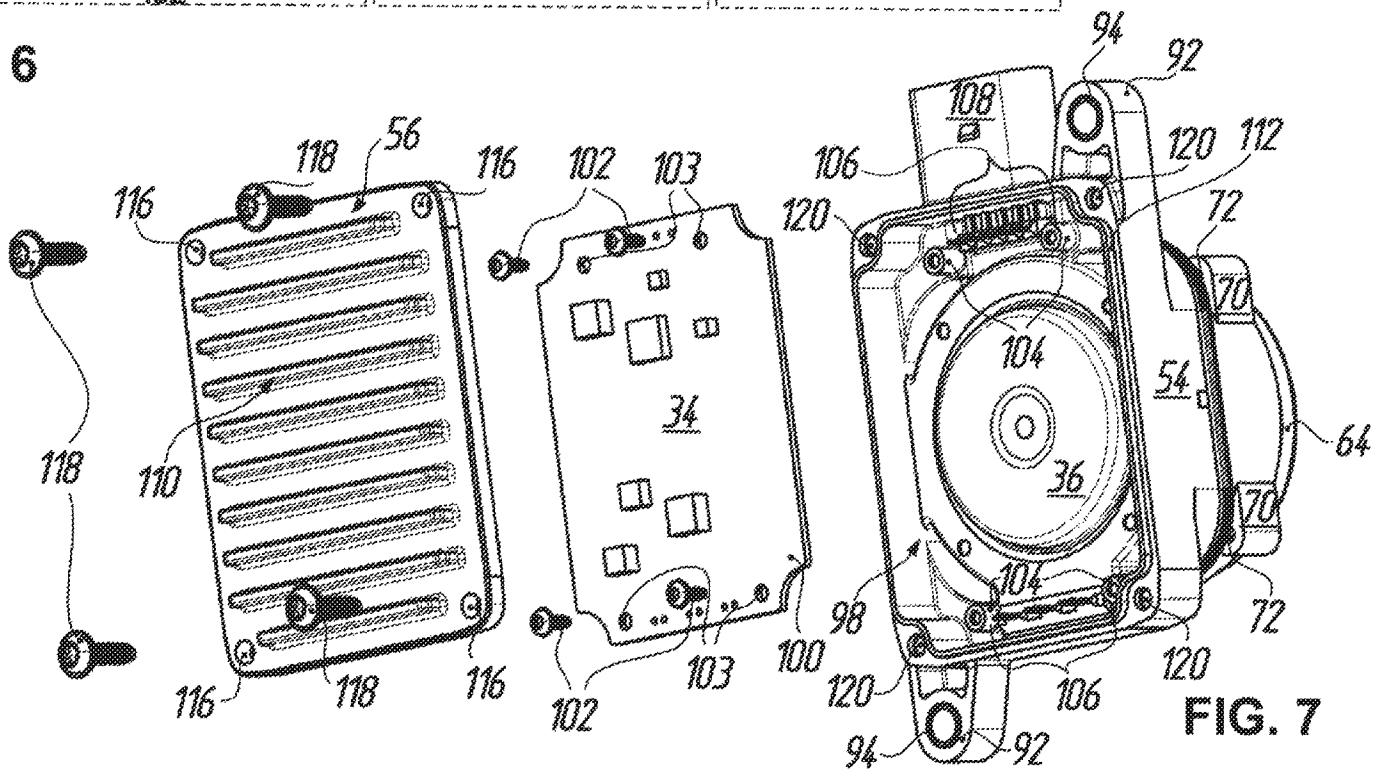
FIG. 7 shows an enlarged illustration of the detail VII in FIG. 6, which shows, in particular, the metallic cover, an electronic power unit and a motor housing section of the housing.

In addition, the connection housing section 50 has on its side remote from the connections 14, 16 a collar 62 by which the connection housing section 50 is plugged onto an associated annular projection 64 of the motor housing section 54. Fastening eyes 66 with passage bores 68 are, according to FIGS. 1 and 9, formed at the outer circumference of the collar 62. As can be seen in FIGS. 4 and 7, the motor housing section 54 has at its outer circumference fastening eyes 70, which are respectively associated with the fastening eyes 66 of the connection housing section 50, with screw holes 72. Fastening of the connection housing section 50 to the motor housing section 54 is by fastening screws 74 (see FIGS. 1, 4 and 9) which extend through the passage bores 68 in the fastening eyes of the connection housing section 50 and are screwed into the screw holes 72 of the fastening eyes 70 of the motor housing section 54 so as to clamp the connection housing section 50 against the motor housing section 54. A circular elastomeric sealing ring 76 inserted between the annular projection 64 of the motor housing section 54 and the collar 62 of the connection housing section 50 seals the interior space 38 of the housing 12 relative to the environment.

As FIGS. 2 and 3 additionally show, the pump housing section 52 is at the same time retained between the connection housing section 50 and the motor housing section 54 to be centered with respect to the axis 26 of rotation and, in particular, by way of an annular fastening flange 78 axially clamped in place between the connection housing section 50 and the motor housing section 54. The pump housing section 52 is in that case positioned and also oriented in angular position about the axis 26 of rotation by way of two pins (not shown), which are mounted on the motor housing section 54 and which pass through associated cut-outs 80 (see FIG. 8) in the fastening flange 78 of the pump housing section 52 and are inserted into corresponding positioning holes 82 (cf. FIG. 9) of the connecting housing section 50.

Radially inwardly adjoining the fastening flange 78 of the pump housing section 52 is a cup-shaped region, which projects in the direction of the interior space 38, with a radially outer circumferential section 84, which forms the afore-mentioned wall surface 48, and a base section 86, which according to FIG. 3 bounds—together with the connecting housing section 50—a receiving space 88 for the moving parts of the conveying device 28, these being described in more detail later. Whereas the suction inlet 30, which is formed to be substantially kidney-shaped as seen in plan view, of the conveying device 38 is provided in the base section 86 (cf. FIG. 8), the fastening flange 78 of the pump housing section 52 is provided with a plurality (here six) of uniformly angularly spaced passage bores 90 which with respect to the axis 26 of rotation are seated at such a radial height that they connect the annular depression 60, which communicates with the suction connection 14, in the connecting housing section 60 with the interior space 38 of the motor housing section 54, as can be seen in FIGS. 2 and 3.

Figure 4:
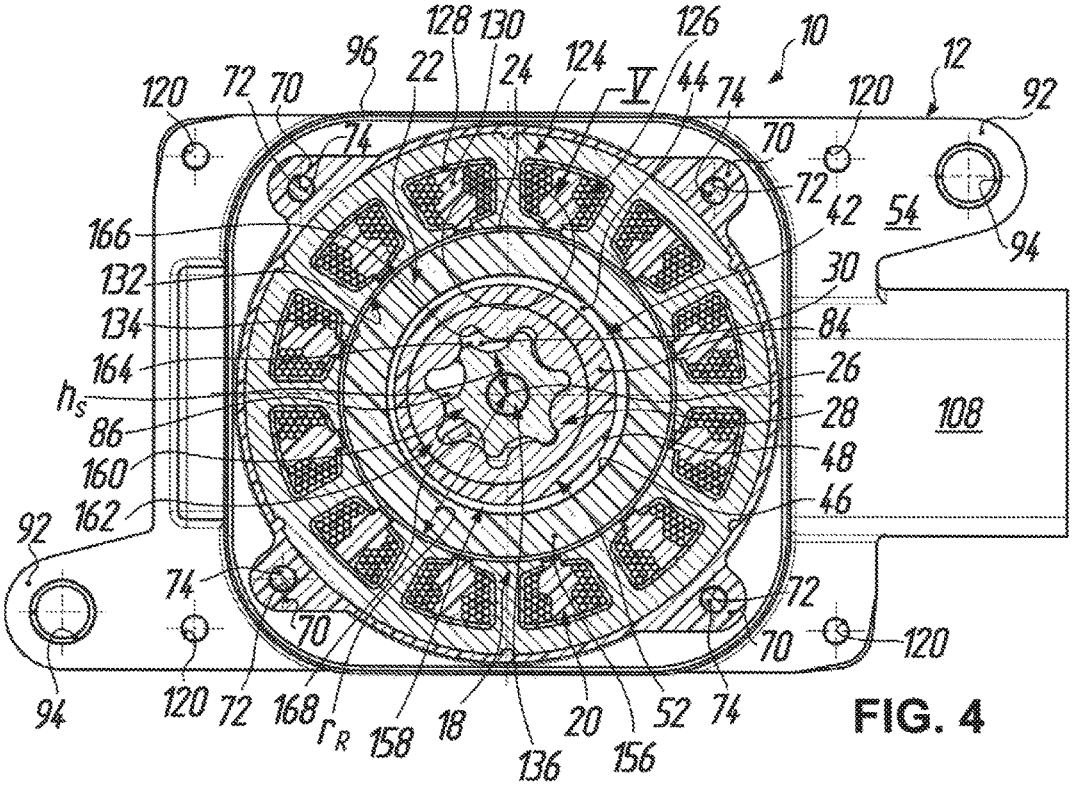
FIG. 4 shows a sectional view of the liquid pump according to FIG. 1 in correspondence with the section line IV-IV in FIG. 2 and, in particular, in a plane in which further details of the electric motor and the conveying device in drive connection therewith can be seen.

According to FIGS. 1, 4 and 7 the motor housing section 54 has at the outside two additional larger fastening eyes 92 which are diametrically opposite one another with respect to the axis 26 of rotation and, lined with reinforcing sleeves 94, serve the purpose of mounting the liquid pump 10 on a wall (not shown) of a transmission housing. A sealing ring 96 mounted on the outer circumference of the motor housing section 54 in that case seals relative to the wall of the transmission housing.

As, in particular, FIG. 7 shows, the motor housing section 54 further defines an electronics chamber 98, which is substantially rectangular as seen in plan view, for reception of the electronic power unit 34. In that regard the partition wall 36 separates the rotor-side interior space 38, which in operation of the liquid pump is flooded or filled with the liquid to be conveyed, from the dry electronics chamber 98. In the illustrated embodiment a circuit board 100 of the electronic power unit 34 is mounted by fastening screws 102, which pass through fastening bores 103 (see FIG. 7) in the circuit board 100, on screw pedestals 104 which are formed at the motor housing section 54 and protrude into the electronics chamber 98 so that the circuit board 100 extends very close to and across the partition wall 36—optionally even in contact with the partition wall 36—as can be seen in FIGS. 2 and 3. The circuit board 100 of the electronic power unit 34 is in that case placed in electrical contact by way of electrical contacts 106 which are embedded in the motor housing section 54—in a manner not shown in more detail with the stator 20 of the electric motor 18 and an electrical terminal, which is indicated in FIGS. 1, 4 and 7 at 108, of the liquid pump 10.

The housing 12 is finally closed on the side of the partition wall 36 remote from the rotor 22 by the metallic cover 56, which for heat dissipation extends outwardly near and over the electronic power unit 34. In the illustrated embodiment, the cover 56 is provided on its side remote from the electronic power unit 45 with a surface-enlarging structure 110 (here in the form of cooling ribs) so that the cover 56 also serves as a cooling body. For centered fastening of the cover 56 to the motor housing section 54 the latter is provided on its end face, which is at the left in FIGS. 2 and 3, with an encircling, axially projecting rim 112 plugged into an encircling groove 114 of complementary shape in the cover 56. In that case, the substantially rectangular cover 56 according to FIG. 7 is provided at its corners outside the groove 114, as seen in radial direction, with passage bores 116. Fastening screws 118 pass through the passage bores 116 in the cover 56 and are screwed into associated screw holes 120 in the motor housing section 54. A liquid seal 122, which is introduced into the groove 114 before plugging the cover 56 onto and screw-connecting it with the motor housing section 54 (see FIGS. 2 and 3), prevents moisture from being able to penetrate into the electronics chamber 98 in operation of the liquid pump 10.

Further details with respect to the electric motor 18 of the liquid pump 10 can be inferred from FIGS. 2 to 5. The stator 20 of the electric motor 18 has a plurality of metallic stator laminations 124 (here approximately 50 sheets) forming the iron core of the stator 20. The stator laminations 124 carry electrical stator windings 126 in a manner known per se and are fixedly connected therewith by a plastic material injection-molded enclosure. As can be seen in FIGS. 2 to 5, the plastic material injection-molded enclosure in that case comprises a preliminary injection-molded enclosure 128 with plastic material between the stack of stator laminations 124 and stator windings 126 and a finishing injection-molded enclosure 130 with plastic material, which arises at the time of formation of the motor housing section 54 and by which the stator 20 is integrated in the motor housing section 54 so that the stator 20 is as a result formed in one piece with the motor housing section 54 of the housing 12. According to FIGS. 4 and 5 the stator laminations 124 have radially inner ends 132 which adjoin or radially outwardly bound the annular gap 24. In that case, the stator laminations 124 and the stator windings 126 are connected together by the afore-mentioned plastic material injection-molded enclosure 128, 130 in such a way that the radially inner ends 132 of the stator laminations 124 are left free of the plastic material injection-molded enclosure 128, 130, thus are left as a "metallic blank", so that liquid flowing through the annular gap 24 in operation of the liquid pump 10 can sweep directly along the radially inner ends 132 of the stator laminations 124 with, in particular, very good heat transfer from the stator laminations 124 to the liquid flowing past.

Figure 5:
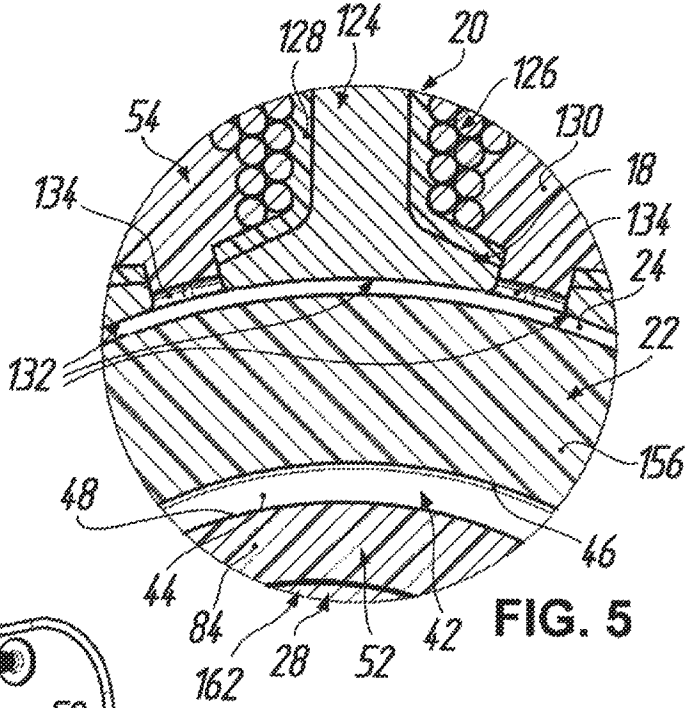
FIG. 5 shows a part sectional view, which is of increased scale, of the liquid pump according to FIG. 1 in correspondence with the detail circle V in FIG. 4, for better illustration of an annular gap formed between rotor and stator of the electric motor and of axial grooves, which adjoin these, at the inner circumference of the stator.

As, especially, FIGS. 3 and 5 additionally show, the afore-mentioned plastic material injection-molded enclosure 128, 130 is formed in such a way that the radially inner ends 132 of the stator laminations 124 project radially inwardly beyond the plastic material injection-molded enclosure and bound therewith grooves 134—in the illustrated embodiment axial grooves—which extend substantially parallel to the axis 26 of rotation. According to FIG. 2 the grooves 134, which provide an additional flow cross-section in the region of the annular gap 24, extend beyond the axial length of the rotor 22.

Details with respect to the rotor 22 of the electric motor 18 can be inferred from, in particular, FIG. 2. The substantially cup-shaped rotor 22 is made from a ferrite which is incorporated in plastic material and which is injection-molded on a metallic motor shaft 136, by way of which the rotor 22 is mounted directly in the plastic material of the housing 12 to be rotatable about the axis 26 of rotation. More specifically, the rotor 22 is cantilever-mounted in the housing 12 on the side of the rotor 22 remote from the partition wall 36 by the motor shaft 136. In that case the motor shaft 136, which produces a drive connection between the rotor 22 of the electric motor 18 and the conveying device 28, extends through the conveying device 28 and is mounted, on either side thereof, in the housing 12 by way of a respective bearing, in particular a central bearing 138, which is closer to the rotor 22, in the base section 86 of the pump housing section 52 and a central bearing 140, which is further from the rotor 22, on the inner side of the connecting housing section 50 (see also FIG. 3).

On the side of the rotor 22 on the left in FIG. 2, a projection 142 is on the partition wall 36 of the housing 12 on its side facing the rotor 22. The projection 142 is arranged concentrically with respect to the axis 26 of rotation and which projects in the direction of the rotor 22, for deflection of the primary flow $S_P$. For low-wear acceptance of axial loads at the rotor 22 an annular collar 144 formed on the motor shaft 136 co-operates, at one end face of the rotor 22, with an annular end surface 146 of the projection 142 in the manner of a thrust washer, whereas on the opposite end face of the rotor 22 a thrust washer 148, which surrounds the motor shaft 136, is inserted between the rotor 22 and the bearing 138 in the pump housing section 52. It can additionally be seen in FIGS. 2 and 3 that the projection 142 has a central recess 150 receiving a magnet 152, which is connected with the rotor 22 by way of the motor shaft 136 and which in the illustrated embodiment serves, in co-operation with a sensor (not shown in more detail) on the circuit board 100 of the electronic power unit 34, for sensing the angular position of the rotor 22 about the axis 26 of rotation. The thus-detected angular position data are used in a manner known per se for electrical commutation of the brushless direct current motor 18.

Figure 8:
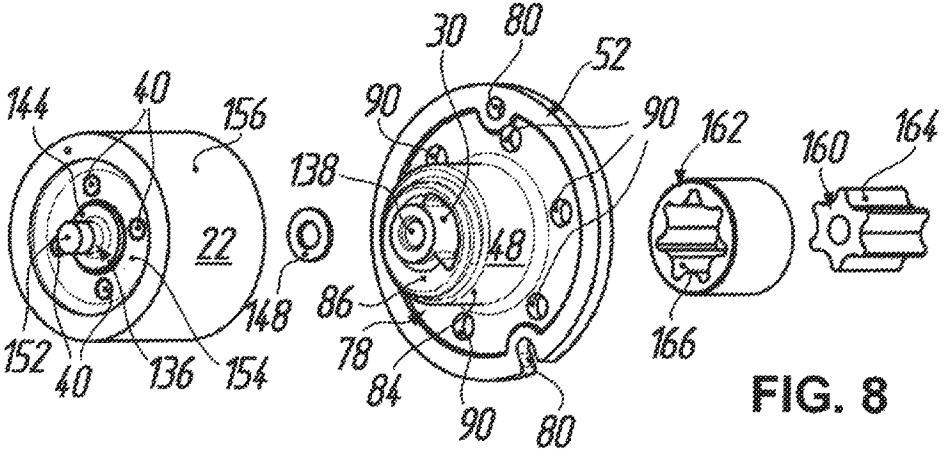
FIG. 8 shows an enlarged illustration of the detail VIII in FIG. 6, which shows, in particular, the rotor, which is seated on a motor shaft, of the electric motor, a pump housing section of the housing as well as an annular gear and a gearwheel of the conveying device.

In addition, it can be readily seen in FIGS. 2 and 8 that the afore-mentioned four passages 40 are formed in a base section 154 of the substantially cup-shaped rotor 22 and, in particular, in such a way that they extend substantially parallel to the axis 26 of rotation. In that case the passages 40 lie at a radial height $h_D$ which, with respect to the axis 26 of rotation, is here greater than an outer radius $R_F$ of the projection 142 so that the deflected primary flow $S_P$ is capable of passing directly through the rotor 22. Moreover, in FIG. 2 it can be seen that the base section 154 of the rotor 22 together with the hollow-cylindrical circumferential section 156 thereof bounds an interior space 158 in which or within which the conveying device 28 is partly received so that the arrangement is of very compact construction in the axial direction.

Details with respect to the conveying device 28 can additionally be inferred from, in particular, FIGS. 2 and 4. Accordingly, the conveying device 28 in the illustrated embodiment is constructed in the form of an internal gear pump with a gearwheel 160 and an annular gear 162 as sintered gerotors. In that case, the gearwheel 160, which is rotationally driven by the rotor 22 of the electric motor 18 by way of the motor shaft 136 and which is arranged concentrically with respect to the axis 26 of rotation, is provided with an outer toothing 164, whereas the annular gear 162 has an inner toothing 166 and is guided eccentrically in the housing 12 with respect to the axis 26 of rotation by the circumferential section 84, which in accordance with FIG. 4 is formed to be laterally offset with respect to the axis 26 of rotation, of the pump housing section 52. When the motor shaft 136 is rotating, the outer toothing 164 of the gearwheel 160 meshes with the inner toothing 166 of the annular gear 162 so as to convey the liquid from the suction inlet 30 to the pressure outlet 32. A respective shadow kidney 168, 170 is formed, as a recess in the plastic material of the housing 12, in the base section 86 of the pump housing section 52 and on the inner side of the connecting housing section 50, to be respectively offset by 180° about the axis 26 of rotation with respect to the suction inlet 30 and the pressure outlet 32 so as to homogenize the liquid flow and suppress pressure pulsations. The drive connection between the motor shaft 136 and the gearwheel 160 ultimately takes place according to FIG. 2 by way of a spline toothing 172 with the feature that the bearing 140, which is further from the rotor 22, in the connecting housing section 50 is lubricated by way of this drive connection.

A liquid pump includes a housing with a suction connection and pressure connection, an electric motor with a stator and rotor therein, a conveying device, which is rotationally driven by the rotor, with a suction inlet and pressure outlet, which communicate with the suction connection and the pressure connection respectively, and an electronic power unit for the electric motor on the rear side of a partition wall, which is adjacent to the rotor and extends transversely to the axis of rotation thereof, of the housing. For a compact construction with at the same time optimized cooling the suction inlet is arranged at a height which—referred to the axis of rotation—is smaller than an inner radius of an annular gap between stator and rotor, whilst the latter has a passage which preferably extends at a constant height so that a liquid inducted by way of the suction connection is in part constrainedly guided via the annular gap and undergoes deflection at the partition wall, with cooling thereof, before it passes through the rotor passage to the suction inlet.

Variations and modifications are possible without departing from the scope and spirit of the present invention as defined by the appended claims.

We claim:

1. A liquid pump that is driven by an electric motor, comprising: a housing, which has a suction connection and a pressure connection, the electric motor housed in said housing and which comprises a stator and a rotor which is received within the stator to leave an annular gap; said rotor being drivable for rotation about an axis of rotation; a conveying device, which is in drive connection with the rotor and which has a suction inlet that, via a fluid path for an unpressurized liquid, is in fluid connection with the suction connection of the housing and a pressure outlet that, via a fluid path for a pressurized liquid, is in fluid connection with the pressure connection of the housing; and an electronic power unit for driving of the electric motor; wherein the housing comprises a partition wall which extends substantially transversely to the axis of rotation and is adjacent to the rotor; and said electronic power unit being mounted on a side of said partition wall remote from the rotor; said liquid pump being characterized in that the suction inlet of the conveying device is arranged at a radial height with respect to the axis of rotation which is smaller than an inner radius of the annular gap, and the rotor has at least one passage which extends at a radial height increasing or substantially constant in direction towards the suction inlet of the conveying device with respect to the axis of rotation so that the unpressurized liquid inducted by the suction inlet of the conveying device via the suction connection of the housing is constrainedly guided in part by way of the annular gap between rotor and stator and undergoes deflection at the partition wall of the housing with cooling thereof before it passes through the passage of the rotor to the suction inlet of the conveying device, wherein the annular gap and the passage of the rotor form part of the fluid path for the unpressurized liquid.

2. A liquid pump according to claim 1, characterized in that the rotor is of substantially cup-shaped construction and bounds an interior space in which the conveying device is received at least in part.

3. A liquid pump according to claim 1, characterized in that the housing is made substantially from plastic material and the rotor of the electric motor is mounted by way of a motor shaft directly in the plastic material of the housing.

4. A liquid pump according to claim 1, characterized in that the conveying device is constructed in the form of an internal gear pump, with a gearwheel, which is rotationally driven by the rotor of the electric motor, arranged concentrically with respect to the axis of rotation, and comprises external toothing, and an annular gear, which meshes with the external toothing, is guided in the housing eccentrically with respect to the axis of rotation, and comprises internal toothing co-operating with the external toothing so as to convey the liquid.

5. A liquid pump according to claim 1, characterized in that the rotor of the electric motor is cantilever-mounted in the housing on a side of the rotor remote from the partition wall.

6. A liquid pump according to claim 1, characterized in that the housing is closed on the side of the partition wall remote from the rotor by a metallic cover which for outward heat dissipation extends near the electronic power unit and over the electronic power unit and is provided on its side remote from the electronic power unit with a surface-increasing structure.

7. A liquid pump according to claim 1, characterized in that a bypass connection is provided which, for improving the cold-running characteristics, connects the suction connection of the housing with the suction inlet of the conveying device in front of the annular gap as seen in flow direction.

8. A liquid pump according to claim 7, characterized in that the bypass connection is formed by a further annular gap between an inner circumferential surface of the rotor and a wall surface of the housing.

9. A liquid pump according to claim 1, characterized in that the stator of the electric motor comprises a plurality of metallic stator laminations which carry stator windings and have radially inner ends adjoining the annular gap, wherein the stator laminations and the stator windings are connected together by a plastic material injection-molded enclosure that the radially inner ends of the stator laminations are left free of the plastic material injection-molded enclosure.

10. A liquid pump according to claim 9, characterized in that the radially inner ends of the stator laminations protrude radially inwardly beyond the plastic material injection-molded enclosure and define axial grooves, extending substantially parallel to the axis of rotation.

11. A liquid pump according to claim 10, characterized in that the axial grooves extend at least over the length of the rotor (22).

12. A liquid pump according claim 1, characterized in that the partition wall of the housing has a projection on its side facing the rotor, said projection is arranged concentrically with respect to the axis of rotation and which protrudes in the direction of the rotor, for the flow deflection.

13. A liquid pump according to claim 12, characterized in that the projection has a central recess in which a magnet, connected with the rotor and serving for sensing the angular position of the rotor about the axis of rotation, is received.

14. A liquid pump according to claim 13, characterized in that the rotor has a plurality of passages which extend substantially parallel to the axis of rotation and which with respect to the axis of rotation lie at a radial height equal to or greater than an outer radial dimension of the projection.

15. A liquid pump according to claim 12, characterized in that a bypass connection is provided which, for improving the cold-running characteristics, connects the suction connection of the housing with the suction inlet of the conveying device in front of the annular gap as seen in flow direction.

16. A liquid pump according to claim 15, characterized in that the bypass connection is formed by a further annular gap between an inner circumferential surface of the rotor and a wall surface of the housing.

17. A liquid pump according to claim 15, characterized in that the rotor is of substantially cup-shaped construction and bounds an interior space in which the conveying device is received at least in part.

18. A liquid pump according to claim 15, characterized in that the conveying device is constructed in the form of an internal gear pump, with a gearwheel, which is rotationally driven by the rotor of the electric motor, arranged concentrically with respect to the axis of rotation, and comprises external toothing, and an annular gear, which meshes with the external toothing, is guided in the housing eccentrically with respect to the axis of rotation, and comprises internal toothing co-operating with the external toothing so as to convey the liquid.

19. A liquid pump according to claim 15, characterized in that the housing is substantially made from plastic material and the rotor of the electric motor is mounted by way of a motor shaft directly in the plastic material of the housing.

20. A liquid pump according to claim 19, characterized in that the rotor of the electric motor is in a drive connection with the conveying device via the motor shaft, which is mounted on either side of the conveying device in the housing by way of a respective bearing, wherein one of said respective bearings, which is further from the rotor, for the motor shaft is lubricated by way of the drive connection thereof to the conveying device.

* * * * *